US006684678B1

(12) United States Patent
Kettner et al.

(10) Patent No.: US 6,684,678 B1
(45) Date of Patent: Feb. 3, 2004

(54) METHOD FOR EXTRACTING A TOOL FROM A HOLLOW OBJECT AND TOOL FOR MACHINING A HOLLOW OBJECT

(75) Inventors: Peter Kettner, Denklingen (DE); Andreas Dietrich, Fuchstal (DE); Hubert Nägele, Fuchstal (DE); Manfred Hirschvogel, Fuchstal (DE)

(73) Assignee: Hirschvogel Umformtechnik GmbH, Denklingen (DE)

( * ) Notice: Subject to any disclaimer, the term of this patent is extended or adjusted under 35 U.S.C. 154(b) by 0 days.

(21) Appl. No.: 10/049,873

(22) PCT Filed: Aug. 7, 2000

(86) PCT No.: PCT/EP00/07640

§ 371 (c)(1),
(2), (4) Date: Aug. 5, 2002

(87) PCT Pub. No.: WO01/14081

PCT Pub. Date: Mar. 1, 2001

(30) Foreign Application Priority Data

Aug. 19, 1999 (DE) ..... 199 39 383
Sep. 13, 1999 (DE) ..... 199 43 805

(51) Int. Cl.[7] ..... B21J 13/02
(52) U.S. Cl. ..... 72/353.4; 72/344
(58) Field of Search ..... 72/344, 345, 353.4, 72/358

(56) References Cited

U.S. PATENT DOCUMENTS 5,765,430 A 6/1998 Iihara et al. ..... 72/353.4

FOREIGN PATENT DOCUMENTS

| | | | | |
|---|---|---|---|---|
| DE | 4433991 A1 | | 3/1996 | |
| FR | 2 649 024 | * | 1/1991 | ..... 72/353.4 |
| JP | 05185177 A | | 11/1993 | |
| JP | 09122815 A | | 9/1997 | |

OTHER PUBLICATIONS

International Search Report for Application No. PCT/EP00/07640, filed Aug. 7, 2000.
International Preliminary Examination for Application No. PCT/EP00/07640, filed Aug. 7, 2000.

* cited by examiner

*Primary Examiner*—Lowell A. Larson
(74) *Attorney, Agent, or Firm*—Marshall, Gerstein & Borun LLP

(57) ABSTRACT

The invention relates to a method for extracting a die (4) from a hollow object (11) having several grooves (16, 17) arranged opposite one another on the surface of the inner sheath whereby the longitudinal axes thereof extend cross-wise relative to the corresponding longitudinal central planes (i.e. cross-grooves), whereby said die (4) is part of a tool (10) having a matrix (1) for forming the hollow object (11) and several other die segments **(9*a*, 9*b*) arranged opposite one another relative to the central axis (2) thereof. Each of said die segments has an outer ridge (21*a*, 21*b*); in order to form the hollow object, said die segments (9*a*, 9*b*) are expanded into a working position, whereby the ridges (21*a*, 21*b*) are fitted into corresponding grooves (16, 17), and extracted after the hollow object (11) has been formed. In order to facilitate extraction, all die segments (9*a*, 9*b*) are extracted by contraction movements (9*d*) perpendicular to the central axis (2) and a relative axial movement (9*c*) between the die segments (9*a*, 9*b*)**.

10 Claims, 3 Drawing Sheets

METHOD FOR EXTRACTING A TOOL FROM A HOLLOW OBJECT AND TOOL FOR MACHINING A HOLLOW OBJECT

The invention relates to a method for removing a tool from a hollow object and a tool for forming a hollow object.

The area of application of the present invention is in particular in the production of outer parts of constant velocity joints. As illustrated diagrammatically in FIG. 3, the outer part of such a joint has a substantially cylindrical inner surface. A plurality of sets of preferably helical grooves are provided, the grooves constituting helices of opposite hand. In order to simplify production, the grooves are normally straight and are inclined, for example at an angle of about 16°, with respect to the axis of rotation of the corresponding joint part, instead of being truly helical. Balls engage in the grooves and are held by a cage, and because of the crossed configuration of the grooves the balls are held in the angle-bisecting plane of the joint when the joint parts are articulated, giving the joint constant velocity properties. Constant velocity joints of this type are known as slip joints or cross-groove joints. As stated, these joints work with straight or helical grooves lying obliquely at an angle of for example $\gamma=16°$ to the axes of the driving and driven body.

Figure 4:
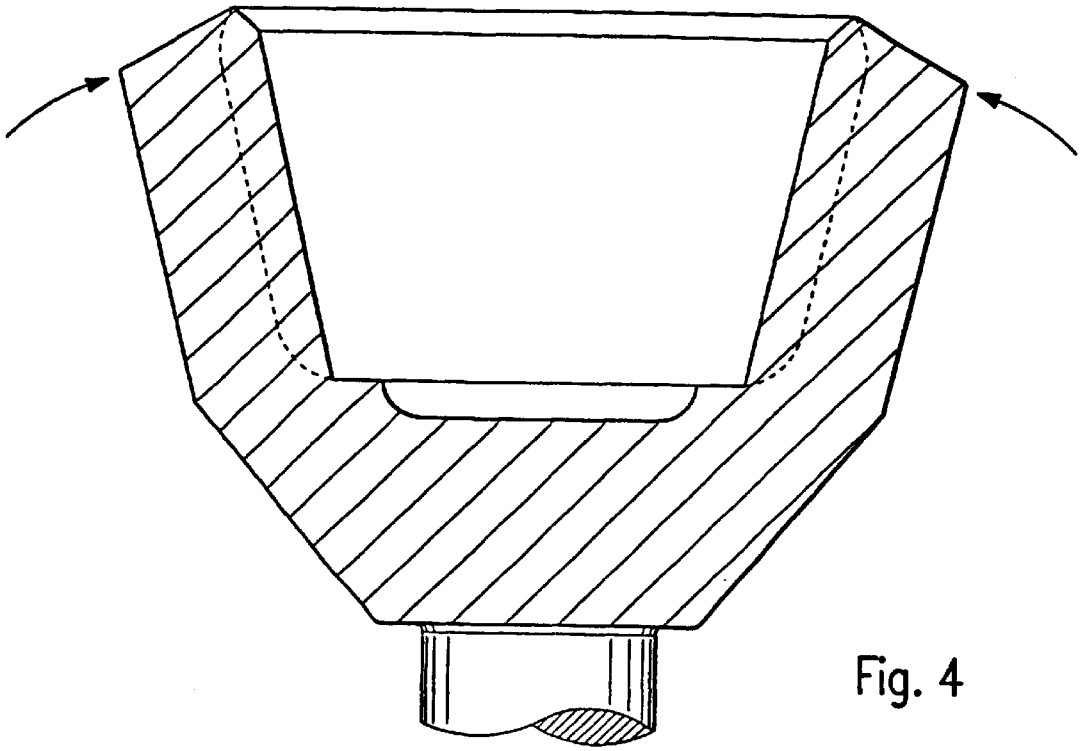

FIG. 4 indicates diagrammatically how parts of this type are fabricated in practice. Starting from a slightly open position of the cup-like outer part, a so-called drawing-in movement is executed, during which the outer walls of the cup-shaped outer part are pushed inwardly, as indicated diagrammatically by arrows.

A method and a tool of this type are described in EP 0 270 538 B1. This known method is carried out using a tool having a ram with a first and a second set of ram segments which are mounted so as to be freely tiltable towards the ram axis, the second set of ram segments being supported on the first set of ram segments. The first set of ram segments can be spread by a mandrel, by which the second set of ram segments can also be spread indirectly via the first set of ram segments. After introduction of the ram in its working position into a hollow object situated in a die, the object is pressed by the ram through the die, the circumferential wall of the hollow object with grooves arranged therein in cross-groove configuration being drawn in and pressed against the ram segments arranged and formed in a manner corresponding to the grooves. After this drawing-in of the hollow object, the mandrel is first withdrawn, so that the first set of ram segments can move inwardly and be disengaged from the grooves. After this, the second set of ram segments, still present in the grooves, can then be pulled out of the hollow object axially, the ram having to be rotated in accordance with the hand of helix of the grooves.

This known method and the known apparatus are complex, both with regard to the design of the tool and with regard to the method steps for removal. The removal of the ram segments requires two successive removal operations, namely on the one hand the movement of the first set of ram segments into a released position and then the axial removal of the second set of ram segments, this having to be rotated with the ram in accordance with the hand of helix of the grooves. The known tool therefore has to be designed such that the ram can execute the specific helical movement. This requires not only a special drive, but also a special helical guide.

A further disadvantage of the known method and of the known apparatus is that the first set of ram segments is displaced into its released position by mechanical contact with the contours of the tool in the region of the grooves.

Such a displacement contact leads, in a rapid operation, which is desirable, to impacts against the first set of ram segments as the ram is being rotated during removal and the first set of ram segments displaced into the released position by the displacement contact. Considerable stressing of the first set of ram segments and resultant wear both on the hollow object and on the ram are thereby inevitable.

The object on which the invention is based is to simplify a method of the type specified at the outset. In addition, the movement of the ram segments into the released position is to be improved.

In the case of the method according to the invention, all the ram segments are removed into their released position by contracting movements, so that a rotary movement of the ram can be dispensed with and the pushing-in movement of the ram segments is sufficient to remove them. Through a further axial relative movement between the hollow object and the ram, these parts can be moved away from one another axially in a simple manner, whereby the hollow object is separated from the ram.

The method according to the invention can therefore be carried out with a significantly simpler tool, since a helical movement for the ram including an associated guide is not required.

The tool here can be designed such that during removal the ram segments are displaced from the grooves owing, for example, to an axial movement of the ram segments, or an active pushing-in device can be provided as part of the tool, which device actively displaces the ram segments into their released position, thereby avoiding a displacement contact and resultant wear between the ram segments and the hollow object.

The further object on which the invention is based is to design a tool such that the ram segments can be removed without displacement contact with the hollow object.

In the case of the tool according to the invention, at least some of the ram segments are assigned a pushing-in device which is part of the tool and which moves the associated ram segments into their released position. If, in the case of the tool according to the invention, only some of the ram segments, namely the ram segments of one hand of helix, are moved into the released position by the associated pushing-in devices, the remaining ram segments of the other hand of helix can be removed by axial unscrewing, as is the case in the prior art. Preferably, all the ram segments are in each case assigned a pushing-in device, so that no unscrewing is required. In the case of the design according to the invention, no displacement contact therefore takes place during removal between the ram segments concerned and the hollow object, and wear on the ram segments and on the hollow object resulting from the displacement contact is therefore also eliminated, as are disruptions resulting from the displacement contact.

The subclaims contain features which further simplify and improve both the method and the tool. It is thus possible, for example, to derive the pushing-in movement from an axial movement of ram segments concerned, so that no special independent drive is required for the ram segments. It is furthermore advantageous and simplifying in this regard to bring about the axial movement of the ram segments by an axial movement caused at the hollow object. The stripping of the hollow object from the ram is thereby simplified and accelerated. Further features in the subclaims lead to simple, small, operationally reliable and inexpensively producible constructions which can be very advantageously integrated into a ram.

The invention and further advantages which can be attained thereby are explained in greater detail below with the aid of preferred configurations and a drawing.

Figure 1:
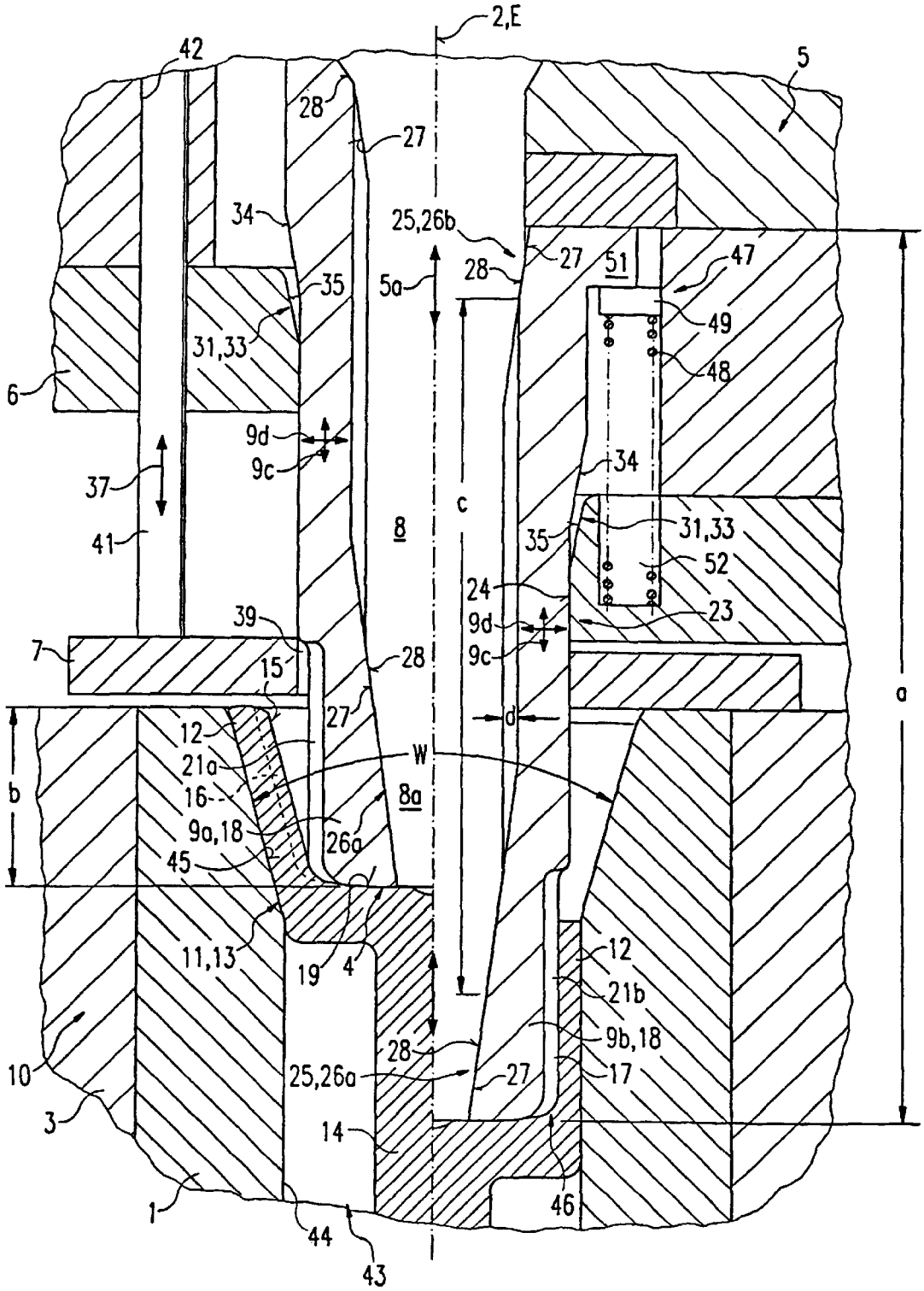
Figure 2:
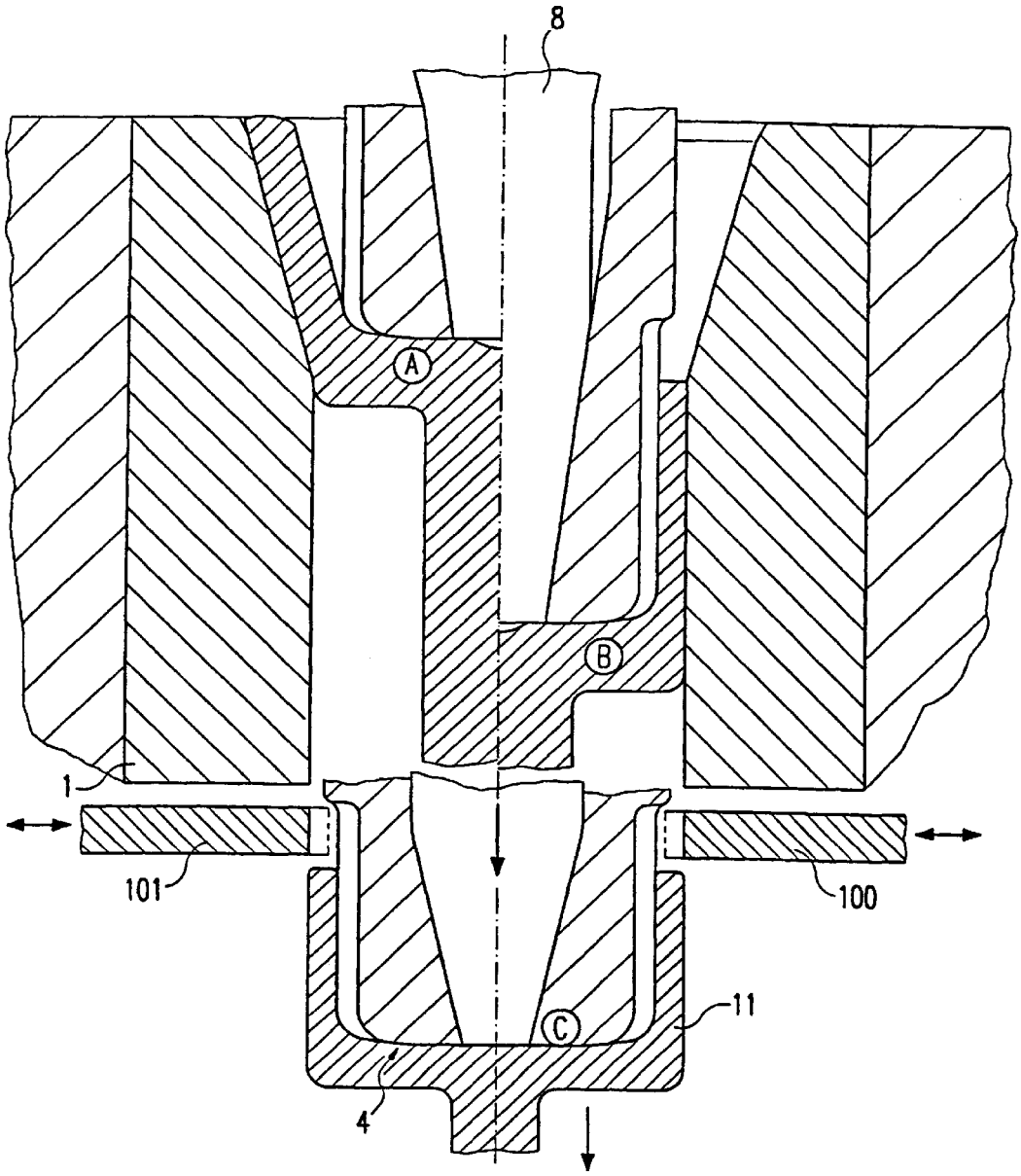
Figure 3:
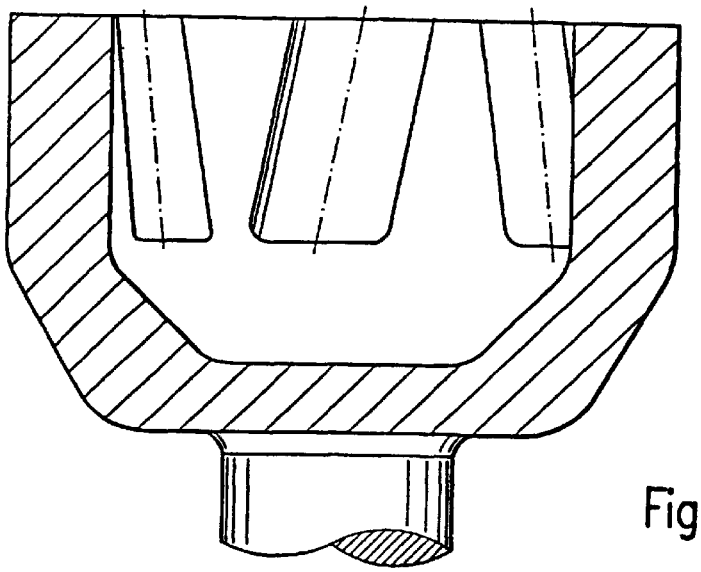

FIG. 1 shows a first exemplary embodiment of the present invention, in which the formed object is ejected upwardly at the end, FIG. 2 shows an alternative exemplary embodiment to FIG. 1, in which the hollow object is transported away from the tool downwardly (falls) after the forming thereof has taken place, FIG. 3 shows a diagrammatic view of the outer part of a slip joint, and FIG. 4 shows diagrammatically the drawing-in movement of the outer walls of the cup-shaped outer part of the slip joint, as executed in a tool according to the present invention.

FIG. 1 shows the main parts of the tool according to the invention in axial section. The main parts are a die 1 in the form of a hollow-cylindrical body, which in the present exemplary embodiment is mounted with a vertical centre axis 2 in a die holder 3, which may be the bottom part of a press. Above the die 1, a ram denoted as a whole by 4 is fixed to a ram holder 5, which is vertically displaceable with the ram 4 in a vertical guide (not illustrated) by a drive (not illustrated), as indicated by the double arrow 5*a*, and which may be the top part of a press.

In addition, a ram ring 6 is arranged, for example fixedly, above the die 1 on the underside of the ram holder 5 and a stripper 7, described hereinbelow, is arranged vertically displaceably below the ram holder 5.

The ram 4 comprises a mandrel 8 with a plurality of, for example 6, ram segments 9*a*, 9*b* arranged spread out over the circumference of the mandrel 8 and mounted radially and axially displaceable relative to the mandrel 8.

A tool 10 thus constructed serves to form a hollow object 11, in the present exemplary embodiment the outer part of a constant velocity joint, in the region of a circumferential wall 12, which is a one-piece part of a pot-shaped body 13, from the bottom wall of which a stem 14 extends coaxially outwards.

The hollow object 11 is in a prefabricated form, in which the circumferential wall 12 is inwardly convergently preformed, as shown in the drawing on the left-hand side of the centre axis 2, in which the hollow object 11 and the tool 10 are at an intermediate stage of a production process. To the right of the centre axis 2, the hollow object 11 and the tool 10 are at a further stage of the process, described hereinbelow.

On the inner lateral surface 15 of the circumferential wall 12 are a plurality of mutually opposite grooves 16, 17 (illustrated in a simplified manner) which extend from the free edge of the circumferential wall 12 to the bottom of the pot-shaped body 13, or may be at a distance from the free edge, and run obliquely or helically in relation to the respectively associated longitudinal centre plane E, there being provided in each case groove pairs which run obliquely or helically in an opposite manner to one another. Such a groove course is known per se, in the case of a constant velocity joint, by the term "cross-groove" and therefore does not need to be described in more detail. The grooves 16, 17 are already preformed on the inner lateral surface 15 in the prefabricated form, as indicated in a simplified manner by a dashed line on the left.

The ram segments 9*a*, 9*b* each have on the outside of a lower end section 18, by which they are movable into the recess 19 of the pot-shaped body 13, a bulge 21*a*, 21*b* (illustrated in a simplified manner), the cross-sectional shape and direction of extension of which corresponds to an associated groove 16, 17, so that the longitudinal axes of the bulges 21, 21*b* cross. The length a, extending in the longitudinal direction of the mandrel 8, of the strip-shaped ram segments 9*a*, 9*b* is dimensioned multiple times greater than the depth b of the recess 19. In the present exemplary embodiment, the length a is dimensioned approximately four times as great as the depth b. As already mentioned, the ram segments 9*a*, 9*b* are preferably mounted in each case such that they can be simultaneously pushed out and in radially or axially parallel in relation to the centre axis 2. For this purpose, there is provided a radial guide 23 which may for example be in the form of guiding grooves on the mandrel 8 or on the ram ring 6, which has an axial through-hole 24 for the ram 4, the cross-sectional shape and size of which corresponds to the cross-sectional shape and size of the ram 4 in the illustrated, radially pushed-out position of the ram segments 9*a*, 9*b*, as shown in FIG. 1. As radial pushing-out device 25 for radial displacement of the ram segments 9*a*, 9*b*, there is provided in each case a wedge drive 26*a*, 26*b* with wedge or cone surfaces 27, 28 extending in each case mutually parallel on the lateral surface of the mandrel 8 and on the inside of the ram segments 9*a*, 9*b*, and to be precise in their end regions, so that between the wedge drive 26*a*, 26*b* respectively associated with a ram segment 9*a*, 9*b* there is an axial centre distance c which is likewise a multiple of the depth b. Associated wedge surfaces 27, 28 are in each case arranged radially offset with respect one another and divergent in the direction of the ram holder 5, so that the ram segments 9*a*, 9*b* are in each case displaced in parallel, radially inwardly upon an axial displacement relative to the mandrel 8 towards the hollow object 11 and radially outwardly upon an opposite axial displacement. Upon a displacement of the mandrel 8, the movements are reversed. The radial stroke d of the ram segments 9*a*, 9*b* is dimensioned greater than the depth of the grooves 16, 17. At the same time, the wedge drives 26*a*, 26*b* are coordinated with one another such that the position of the bulges 21*a*, 21*b* in the pushed-out position corresponds to the position of the grooves 16, 17 in the finished position of the circumferential wall 12 and in the radially pushed-in position the bulges 21*a*, 21*b* are situated within the hollow-cylindrical free space of the recess 19. In the radially pushed-out position of the ram segments 9*a*, 9*b*, their free ends, which face the hollow object 11, and the free end of the mandrel 8 terminate approximately flush with one another. As the ram segments 9*a*, 9*b* are pushed in radially, they are simultaneously displaced axially into a position protruding from the free end 8*a* of the mandrel 8 (not illustrated), which is described hereinbelow. The wedge or cone surfaces 27, 28 of the front wedge drive 26*a* are situated in the free end region 8*a* of the mandrel and in the front end region 18, in which the bulges 21*a*, 21*b* are also situated on the outside.

The ram segments 9*a*, 9*b* are in each case assigned a substantially radially inwardly directed pushing-in device 31, which displaces them from their radially pushed-out working position inwardly into a released position, this pushing-in device 31 in each case cooperating with a longitudinally acting adjusting device, by which the ram segments 9*a*, 9*b* are longitudinally displaceable from their working position at the rear in relation to the mandrel 8 into the front released position towards the free end section 8*a* of the mandrel 8. The pushing-in device 31 is likewise formed by a wedge drive 33 with an outer wedge or cone surface 34 on the outside of the associated ram segment 9*a*, 9*b* and an inner wedge or cone surface 35 on the ram ring 6, it being possible for the latter surface to be arranged in the through-hole 24. The stripper denoted by 7 which has already been mentioned is vertically displaceable independently of the ram holder 5, which is indicated by the double arrow 37. It may be formed by a ring or a plate with a through-hole 39, through which the ram 4 extends with play. For vertical displacement of the stripper 7, there may be provided a rod 41, which in the present exemplary embodiment is displaceably mounted in a vertical guiding hole 42 in the ram holder 5 and in the ram ring 6 and is displaceable up and down by a drive (not illustrated).

The operation and a working mode of the tool 10 are described below.

In a starting position (not illustrated), the ram 4, the stripper 7 and the ram holder 5 with the ram ring 6 are situated at such a distance above the die 1 that a hollow object 11 can be inserted into a corresponding receiving hole 43 corresponding to the prefabricated form of the hollow object 11. The receiving hole 43 is formed by a bore 44 and a conical bore widening 45 in the upper edge region of the die 1, the cone angle W of which corresponds to the cone angle of the hollow object 11 in its prefabricated form, and the cross-sectional size of the bore 44 corresponds to the cross-sectional size of the finished form of the hollow object 11, so that the latter can be inserted into the receiving hole 43 such that the divergent circumferential wall 12 is situated in the hole widening 45. The insertion of the optionally heated hollow object 11 takes place in a given position of the grooves 16, 17 in relation to the circumferential direction which corresponds to the position of the bulges 21*a*, 21*b*.

Thereafter, the ram 4 is moved into the recess 19 by its ram segments 9*a*, 9*b* which are each situated in the working position, it being possible for the front ends of the ram segments 9*a*, 9*b* and optionally also the front end of the mandrel 8 to butt against the bottom wall of the pot-shaped body 13 and for the ram 4 to be advanced in one movement into the stroke position illustrated on the right in the figure, the circumferential wall 12 being drawn in with its grooves 16, 17 against the bulges 21*a*, 21*b* and in the process the grooves 16, 17 being able to be postformed or calibrated, or optionally also completely formed, at which point the forming operation of the hollow object 11 is completed. In this working position, an axially acting positive-locking connection 46 is present between the circumferential wall 12 and the forming segments 9*a*, 9*b*, which is caused by the engagement of the bulges 21*a*, 21*b* in the grooves 16, 17.

After reaching the bottom dead centre, the hollow object 11 and the ram 4 are moved together out of the die 1, for which purpose a pushing-out ram (not illustrated) acting from below against the hollow object 11 can be used.

Thereupon, the stripper 7, as part of the adjusting device for the axial movement of the ram segments 9*a*, 9*b* relative to the mandrel 8, is advanced towards the hollow object 11. The ram segments 9*a*, 9*b* take part in this forward movement, since their bulges 21*a*, 21*b* are situated in the grooves 16, 17 and thus the positive-locking connection 46 continues to exist between the ram segments 9*a*, 9*b* and the hollow object 11. During this forward movement, the wedge drives 33 act as drive mechanisms which convert the axial forward movement of the ram segments 9*a*, 9*b* into a radially inwardly directed pushing-in movement 9*d*, whereby the ram segments 9*a*, 9*b* are simultaneously pushed inwardly, as a result of the fact that the wedge and cone surfaces 34, 35, which have previously been arranged close to one another, come into contact with one another and initiate the wedge driving action. When the ram segments 9*a*, 9*b* are in their inwardly displaced released position, the catching connection or positive-locking connection 46 with the hollow object 11 is no longer effective, so that the latter is also stripped from, or can fall off, the ram segments 9*a*, 9*b*.

During the longitudinal displacement of the ram segments 9*a*, 9*b* owing to the catching with the hollow object 11, a retracting device 47 for the ram segments 9*a*, 9*b* with one or more springs 48, for example compression springs, arranged spread out on the circumference is biased. For this purpose, the retracting device 47 may have one or more stop parts 49 or a stop ring which engages behind a radial projection 51 at the rear end of the ram segments 9*a*, 9*b*. As soon as the positive-locking catching between the ram segments 9*a*, 9*b* and the hollow object 11 has ended owing to the radially inward displacement of the ram segments 9*a*, 9*b*, the ram segments 9*a*, 9*b* are pushed back into their starting position by the retracting device 47, in the course of which they are simultaneously shifted in parallel outwardly into their working position by the wedge drives 26*a*, 26*b*. In the present exemplary embodiment, the spring 48 is arranged in a blind hole 52, open at the top, in the ram holder 5 or in the ram ring 6 and clamped between the bottom thereof and the stop part 49.

An essential feature of the tool 10 according to the invention is thus the automatically acting pushing-in device 31, which displaces the ram segments 9*a*, 9*b*, during their axial forward movement, radially inwardly into their released position, in which the positive-locking connection 46 is disengaged and thus the hollow object 11 is freed and can then be stripped or in the present exemplary embodiment fall off. As a result, a simple and trouble-free operation coupled with a simple design of the tool 10 is ensured. As the present construction makes clear, the pushing-in device 31 and also the adjusting device can be realised in simple and cost-effective constructions, which can also be integrated into the tool 10 in a simple manner and are operationally reliable.

The pushing-in device 31 is arranged in the axial direction between the associated wedge drives 26*a*, 26*b*, the wedge or cone angle of the cone or wedge surfaces 34, 35 on the one hand and 27, 28 on the other hand being substantially identical and, in the working position according to the drawing, the cone or wedge surfaces 34, 35 of the wedge drive 33 being only at a small distance from one another. As a result, an inward parallel displacement or radial displacement of the ram segments 9*a*, 9*b* is likewise substantially ensured.

Within the scope of the invention, the adjusting device 32 may also be formed by a correspondingly axially acting advancing device acting directly on the ram segments 9*a*, 9*b* .

In the present exemplary embodiment, all the ram segments 9*a*, 9*b* are preferably moved simultaneously into the above-described released position, so that an axial retracting movement of the ram segments 9*a*, 9*b* and a further axial movement of the mandrel 8, where necessary, are sufficient to effect the removal of the ram 4 from the hollow object 11.

However, within the scope of the invention, it is also possible to provide the pushing-in device 31 in each case only for the forming segment or segments 9*a* or 9*b* of either the oblique course or the helical course of the associated bulges 21*a* or 21*b*, so that only one type of ram segments 9*a* or 9*b* is displaced into the released position, while the other type remains in the working or engaged position. In the case of such a design, upon the axial withdrawal of the ram segment or segments which are in engagement, a helical movement corresponding to the oblique or helical course of the associated bulge is required, as is the case in the prior art described at the outset. Such a design according to the invention also produces reliable operation, since the at least one ram segment is automatically moved into its released position before removal and thus a trouble-free operation is ensured.

In the device according to FIG. 1, after the removal and withdrawal of the ram, the formed hollow object is ejected upwardly by an ejecting device and then taken away from the tool by a suitable manipulator, for example.

FIG. 2 illustrates an alternative exemplary embodiment which differs from the exemplary embodiment according to FIG. 1 merely in that the tool is designed in such a way that the formed hollow object can fall away downwardly at the end.

As can be seen in FIG. 2, the stroke of the ram 8 is dimensioned such that, after the drawing, in movement in the tool die 1, it can push the hollow object 11 thus formed downwardly out of the die 1. The process thus proceeds from the position A, in which the walls have not yet been drawn in, to a position B, in which the forming movement is completed, and on to a position C, in which the ram 8 has already pushed the formed object 11 downwardly out of the die 1. To remove the ram from the hollow object 11 against the frictional forces occurring at the contact surfaces between the ram segments and the inside of the wall of the hollow object 11, a pusher 100, 101 is now moved inwardly until it is above the upper side of the outer wall of the hollow object 11. In this moved-in state of the pusher device 100, 101, the ram 8 can now be pulled out upwardly and the corresponding drawing-in movements for the ram segments actuated. The hollow object 11, which apart from the frictional/positive-locking engagement with the ram segments otherwise hangs in the air so to speak, is now held back by the pusher device 100, 101. As soon as the ram 8 has therefore become detached upwardly from the hollow object 11, the hollow object 11 falls away downwardly and can be transported away for further processing by a conveyor belt, for example.

This embodiment according to FIG. 2 is advantageous compared with that of FIG. 1 in that the ejector for ejecting the formed object 11 upwardly at the end can be dispensed with. The pusher device 100, 101 with stripping action, which is additionally required in the exemplary embodiment of FIG. 2, is in contrast considerably less complex in terms of construction.

What is claimed is:

1. A method for removing a ram from a hollow object, the hollow object having a plurality of grooves which are arranged opposite one another on its inner lateral surface and the longitudinal center axes of the hollow object of which run obliquely in relation to the associated longitudinal center plane, the ram being part of a tool with a die for forming the hollow object, and having a mandrel and also a plurality of ram segments arranged opposite one another in relation to the center axis of the mandrel, each with a bulge on the outside, the ram segments for forming the hollow object being spread into a working position, in which the bulges fit associated grooves, by first wedge or cone surfaces which are arranged on the lateral surface of the mandrel and on the insides of the ram segments in their free end regions and come into contact with one another upon the relative movement between the mandrel and the ram segments, and after the forming of the hollow object being contracted into a released position and removed, the method comprising the steps of:

spreading the ram segments by the first wedge or cones surfaces and simultaneously by a second wedge or cone surfaces arranged at an axial distance from the first wedge or cone surfaces, contracting the ram segments by a third wedge or cone surface and a contact part cooperating therewith on the outsides of the ram segments of the tool, the third wedge or cone surface and the contact part being arranged, in relation to the axial distance, between the first and second wedge or cone surfaces, and removing the ram segments.

2. The method according to claim 1, wherein the ram segments are axially moved.

3. The method according to claim 2, wherein after its forming operation the hollow object is moved out of the die with the ram and thereafter the axial movement of the ram segments is executed.

4. The method according to claim 3, wherein the axial movement is produced by stripping the hollow object from the ram.

5. A tool for forming grooves on the inner lateral surface of a hollow object, having a die with a die hole, into which the hollow object can be inserted, a ram which is fixed to a ram holder and is mounted so as to be axially displaceable therewith to and fro in relation to the die, and which has a mandrel arranged axially in relation to the ram and a plurality of ram segments arranged spread out over the circumference of the mandrel, which have at their outsides bulges fitting the grooves, which are movable axially and transversely relative to the mandrel between a working position coinciding with the grooves and a released position arranged outside the grooves, are mounted in a ring surrounding the ram segments, and can be spread into the working position by an axial movement of the mandrel, in each case mutually fitting first and second wedge or cone surfaces, which are arranged on the lateral surface of the mandrel and on the insides of the ram segments in the free end regions of the mandrel and of the ram segments and at an axial distance therefrom, upon an axial relative movement between the mandrel and the ram segments, coming into contact with one another and effecting the spreading of the ram segments, and the ram segments in each case being assigned a pushing-in device which is arranged axially between the first and second wedge or cone surfaces and by which the ram segments are actively movable into their released position, comprising:

the pushing-in device being formed by third wedge or cone surfaces and a contact part cooperating therewith on the outsides of the ram segments and on the ring surrounding the latter, the ram segments arranged to be axially displaceable in the ring, and the third wedge or cone surfaces arranged to effect contraction and removal of the ram segments.

6. The tool according to claim 5, wherein a component of the tool is formed by a ring or a plate with a hole, in which the ram is received with play.

7. The tool according to claim 5, further comprising a stripper arranged to strip the hollow object from the ram.

8. The tool according to claim 5, wherein the ram segments are assigned a retracting device having one or more springs that are stressed upon the axial forward movement of the ram segments and bias the ram segments into an axial starting position.

9. The tool according to claim 5 wherein the contact part is formed by a third wedge or cone surface.

10. The tool according to claim 5, wherein wedge or cone angles of the first, second and third wedge or cone surfaces are identical.

* * * * *

UNITED STATES PATENT AND TRADEMARK OFFICE

CERTIFICATE OF CORRECTION

PATENT NO. : 6,684,678 B1
DATED : February 3, 2004
INVENTOR(S) : Peter Kettner et al.

It is certified that error appears in the above-identified patent and that said Letters Patent is hereby corrected as shown below:

Title page, Item [54] and Column 1, lines 1-3,
Title, please delete "METHOD FOR EXTRACTING A TOOL FROM A HOLLOW OBJECT AND TOOL FOR A MACHINING A HOLLOW OBJECT" and insert -- METHOD FOR REMOVING A TOOL FROM A HOLLOW OBJECT AND TOOL FORMING A HOLLOW OBJECT --.

Signed and Sealed this

Thirteenth Day of April, 2004

JON W. DUDAS
*Acting Director of the United States Patent and Trademark Office*